US005113937A

United States Patent [19]

Cholet

[11] Patent Number: 5,113,937

[45] Date of Patent: May 19, 1992

[54] DEVICE FOR SEPARATING A MIXTURE OF FREE GAS AND LIQUID AT THE INTAKE OF A PUMP AT THE BOTTOM OF A DRILLED WELL

[75] Inventor: Henri Cholet, Le Pecq, France

[73] Assignee: Institut Francais de Petrole, Rueil Malmaison, France

[21] Appl. No.: 635,249

[22] Filed: Dec. 28, 1990

[30] Foreign Application Priority Data

Dec. 28, 1989 [FR] France ..... 89 17520

[51] Int. Cl.[5] ..... E21B 43/38

[52] U.S. Cl. ..... 166/105.5; 166/369

[58] Field of Search ..... 166/105.5, 105.6, 105, 166/106, 369, 264, 104; 418/48, 181; 417/405, 435

[56] References Cited

U.S. PATENT DOCUMENTS

| | | | |
|---|---|---|---|
| 2,810,352 | 10/1957 | Tumlison | 166/105.5 X |
| 3,128,719 | 4/1964 | Jongbloed et al. | 166/105.5 |
| 4,386,654 | 6/1983 | Becker | 166/105.5 |
| 4,592,427 | 6/1986 | Morgan | 166/369 |
| 4,762,176 | 8/1988 | Miller | 166/105.5 |

*Primary Examiner*—Stephen J. Novosad

*Attorney, Agent, or Firm*—Antonelli, Terry Stout & Kraus

[57] ABSTRACT

A device is disclosed for separating a mixture of free gas and liquid at the intake of a pump connected to a bottom end of a tubular column at the bottom of a drilled well. The pump is connected to the tubular column by an intermediate production tube and is introduced into a fluid intake device a bottom end of which is closed and a top end comprises fluid introduction orifices, said pump being placed inside said intake device, close to its bottom end, said intake device comprising, close to its bottom end, a device forming at least a check valve.

10 Claims, 3 Drawing Sheets

A
A
B
B
C
C
d
2
3
4
5
6
7
8
9
10
10
11
11
15
16
30
32
33
34
35
36
37
38
39
40
41

DEVICE FOR SEPARATING A MIXTURE OF FREE GAS AND LIQUID AT THE INTAKE OF A PUMP AT THE BOTTOM OF A DRILLED WELL

BACKGROUND OF THE INVENTION

1. Field of the Invention

The present invention relates to a device for separating a mixture of gas and liquid, this mixture being formed particularly by hydrocarbons, at the intake of a pump connected to the bottom end of a tubular column at the bottom of a drilled well.

After the positioning of wells drilled towards the reservoir of the geological formation, hydrocarbon production installations use pumping systems to raise the oil to the surface. For this operation, a tubular column is lowered into the drilled well serving as a pipe for producing the hydrocarbons at the end of which is disposed a pump.

2. Description of the Prior Art

The pumps used may be of different types: piston pumps, centrifugal pumps, hydraulic pumps, beam pumps, rotary positive displacement pumps (commercially called "MOINEAU" pumps).

Although such pumps operate satisfactorily when the pumped fluid is formed for the most part of liquid, problems arise and develop when a volume of free gas is mixed with the production fluid. In fact, if the intake pressure of a fluid to a pump is less than the bubble point pressure above which all the gas is dissolved in the oil, pumps intake free gas mixed with the production fluid.

Under these conditions, the result is a low pumping efficiency if the flowrate measured from the reservoir is related to the theoretical delivery of the pump and acceleration of the working of the pump affecting the increase of the speed of rotation for piston pumps.

The prior art, illustrated by the two patents, GB 983 644 and U.S. Pat. No. 2,969,742, have solved this problem by using a gas/liquid separation device mounted around the pump for limiting as much as possible the presence of gas in suspension in the liquid during working of the pump. The pump is introduced at the bottom of a tubular pipe which is closed at its lower part and provided with intake orifices at its upper part so that, at the level of the orifices of the separator, the free gas tends to be removed to the surface, whereas the oil is sucked in by the pump.

However, such an assembly has a serious drawback which corresponds to the dry operation of the pump when the liquid level does not reach the intake orifices.

The most harmful effect is found in a reduction of the useful life of positive displacement pumps of MOINEAU type in which the gas introduced tends to filter into the elastomer of the stator and so deform the inner helical gears of the pump. In other types of pump, the wear is amplified by a risk of blockage of the pump.

SUMMARY OF THE INVENTION

The object of the present invention is to overcome the above dry operation, wear and deterioration drawbacks of the pumps.

The object of the present invention is a separation device for separating a mixture of free gas and liquid at the intake of a pump connected to a bottom end of a tubular column at the bottom of a drilled well, the pump being connected to the tubular column by an intermediate production tube and being positioned within a fluid intake device. The fluid intake device having a bottom end that is closed and a top end that comprises fluid introduction orifices; the pump being placed inside said intake device close to the bottom end.

According to the invention, the intake device comprises, close to the bottom end, a device forming at least a check valve.

The intake device may comprise a tube and the device forming at least a check valve may be placed in the axis of said tube.

The intake device may comprise a cylindrical tube, the device forming at least a check valve may be placed on the cylindrical walls of said intake device.

The intake device may comprise an intake duct surrounding the intermediate production tube and the pump coaxially, the intake duct being extended by a separation duct having orifices circumferentially and held in position about the tubular column by a fixing piece.

The intermediate production tube and the pump may be held in position coaxially to the intake duct by centring means.

The device forming at least a check valve may comprise a closing device, such as a ball or pressure valve, constantly urged by elastic means to block a fluid introduction opening in the intake duct.

The elastic means may have a compression resistance at a minimum pressure, said minimum pressure corresponding to a liquid level in the intake duct above the pump.

The intake duct and the separation duct may be held in position in the drilled well by stabilizers.

The length of the fluid intake device may be chosen so as to develop a pressure difference of a few bars between the intake level of the pump and the level of the fluid introduction orifices in said device.

The present invention applies to a pumping installation in a drilled well comprising a separation device, and comprises a bottom zone whose orientation varies from the vertical to a high slope.

BRIEF DESCRIPTION OF THE DRAWINGS

A particular embodiment of the invention will now be described in detail which will better show the essential characteristics and advantages, it of course being understood that this embodiment is chosen by way of example and that it is in no wise limitative. The description is illustrated by the accompanying drawings in which.

DESCRIPTION OF THE PREFERRED EMBODIMENTS

Figure 1:
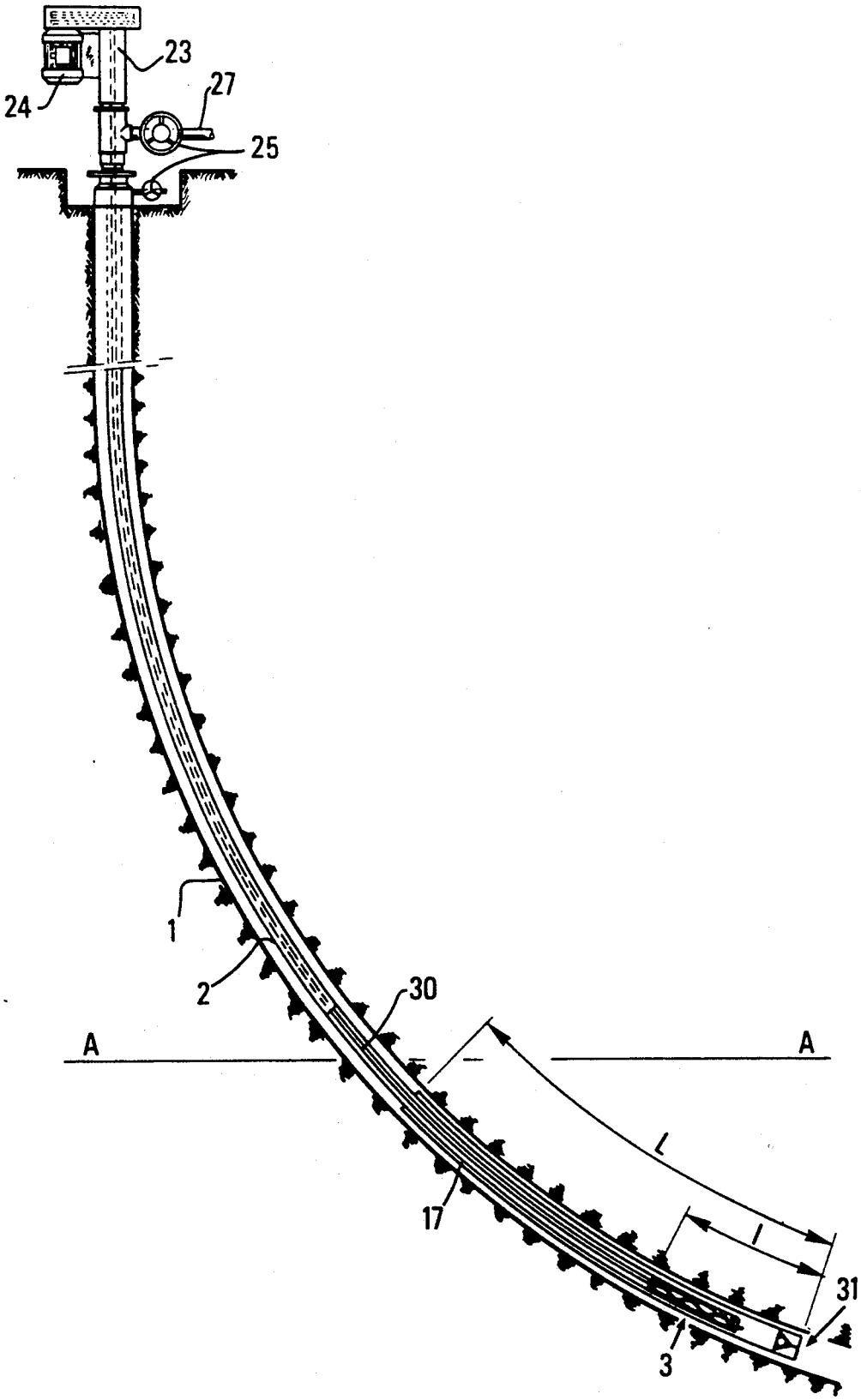
FIG. 1 shows the section of a drilled well with a highly sloped bottom zone.

FIG. 1 shows a drilled well into which is introduced a pump 3 placed in an active position at the bottom of the well by a tubular duct or column 2. The drilled well comprises, close to its surface, a practically vertical zone extended downwards by a deviated portion so as to become, in its bottom part, highly inclined in a zone with a high content of fluid which can be drawn off. The present invention applies quite particularly in the case of highly deviated wells, but it also has all its advantages in the case of vertical wells.

Pump 3 fixed to the end of column 2 is introduced from the surface and progresses through the well by the addition of tubular sections.

Then into the duct is introduced a set of drive rods 30 placed end to end and whose rotation is controlled by a drive head 23 connected to a motor 24 which may be of a type commonly used in pumping installations. The rotation of rods 30 primes the pumping device 3 which raises the fluid flowing at the bottom of the well through the tubular column 2 to be discharged towards the storage ducts 27. Valves 25 regulate the distribution of the pumped fluid at the surface.

Pump 3 is introduced at the end of the tubular column 2 into a separation device 17 for causing the free gas in suspension in the liquid to rise to the surface, whereas the liquid is sucked towards the bottom of the separation device at the intake of pump 3.

Reference 31 designates a closure device of the check valve type.

Figure 2:
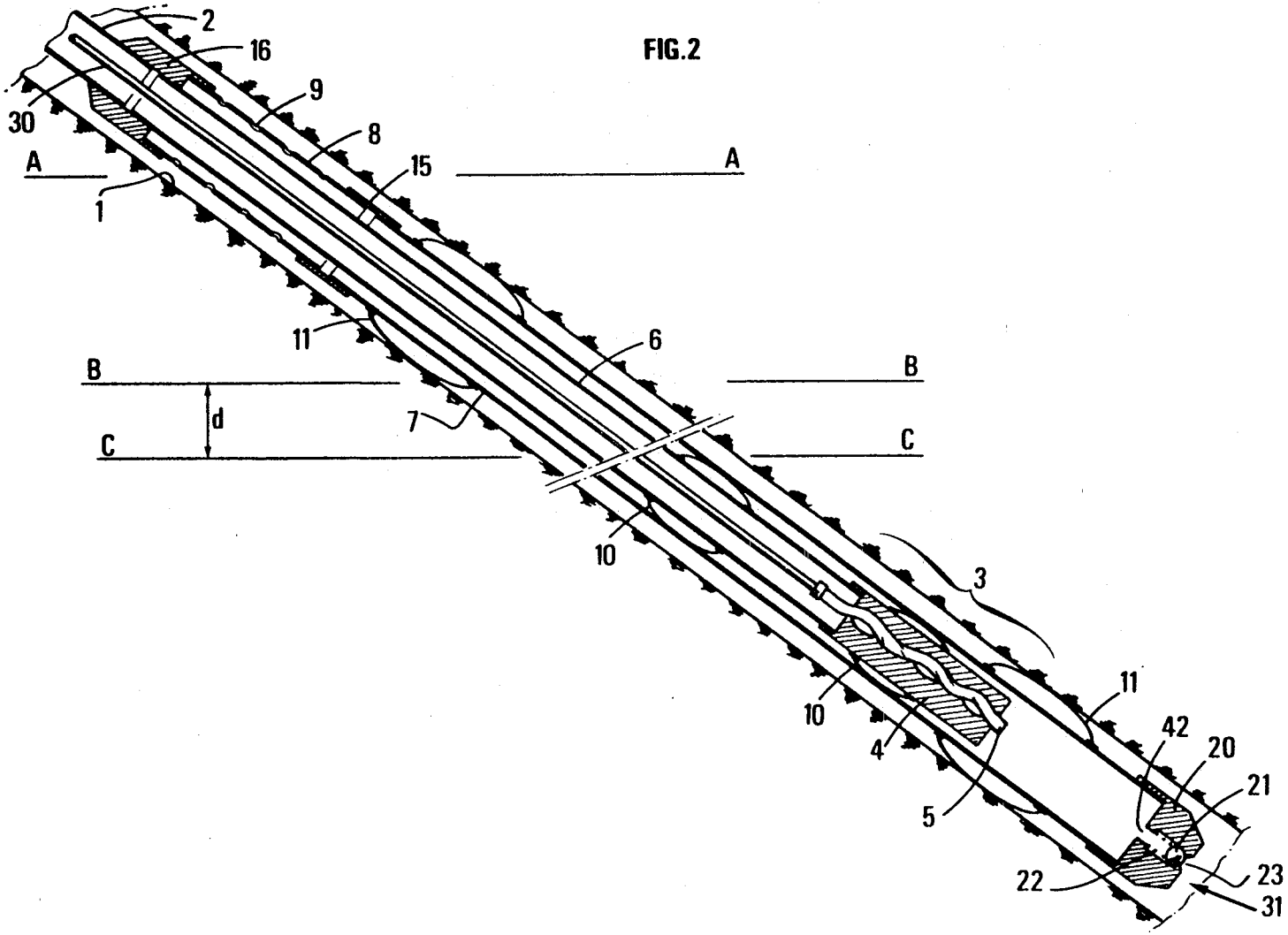
FIGS. 2 and 3 show gas/liquid separation devices associated with a pump at the end of a tubular column comprising respectively two different variants of the closure device.

The construction of this separation device is clearly visible in FIG. 2.

The bottom end of the tubular column 2 at the bottom of the well is coupled at its circumference to an end of an intermediate production tube 6. The other end of this intermediate tube is connected to the output of the pumping device. In the example shown, a MOINEAU type pump is used, but of course the advantages of the present invention would apply just as favourably in the case of a piston pump, a centrifugal pump or a beam pump.

The MOINEAU pump 3 comprises a stator 4 provided with a steel tubular protective casing, covering an elastomer portion or active piece of the stator forming on the inside a helical gear.

A set of rods 30, placed end to end, which disposed inside the tubular column 2, passes through the intermediate production tube, and supports a rotor 5 so as to transmit thereto a rotary movement controlled from the surface. This rotor 5 comprises on its surface a helical gear associated with stator 4.

The pump/intermediate production tube assembly is introduced into an intake duct 7, in the form of a tubular pipe open at both ends. A first end is extended by a separation duct 8 formed of a tubular liner with orifices 9 for the introduction of fluid into duct 7.

The separation duct 8 and the intake duct 7 are connected together by a circular ring 15.

The separation duct 8 is held in a fixed position around the intermediate production tube by a connecting member 16, this member comprising an inner threaded zone in which is screwed the upper end of the separation duct. 8.

This member 16 also ensures the coaxial holding and end to end positioning of the tubular column 2 and the intermediate production tube 6.

In order to hold pump 3 and the intermediate production tube 6 coaxial with the intake duct in its axis, centering devices 10 are placed around these elements. These centering devices are, for example of the blade type, well known in ground drilling techniques. Other types of centering devices may also be used, for example rubber devices. These centering devices also have the advantage of limiting the oscillatory movement of the pump in a section of the well.

Stabilizers 11 of the above type are also placed around the intake duct 7 for placing the assembly in the axis of the well.

According to the invention, the bottom end of the intake duct has a closure device 31 comprising a piece 20 forming a closure in which a check valve is provided. This check valve is formed by a ball 21 constantly urged to block a fluid introduction opening 23 by elastic means, such for example as a helical spring 22.

The example shown in FIGS. 1 and 2 discloses the use of a valve placed at the end of the intake duct substantially in the axis of the pump. In this embodiment, there is a risk of accumulation of sediment above orifice 42 which may clog the latter and hinder the operation of the closure device 31.

Figure 3:
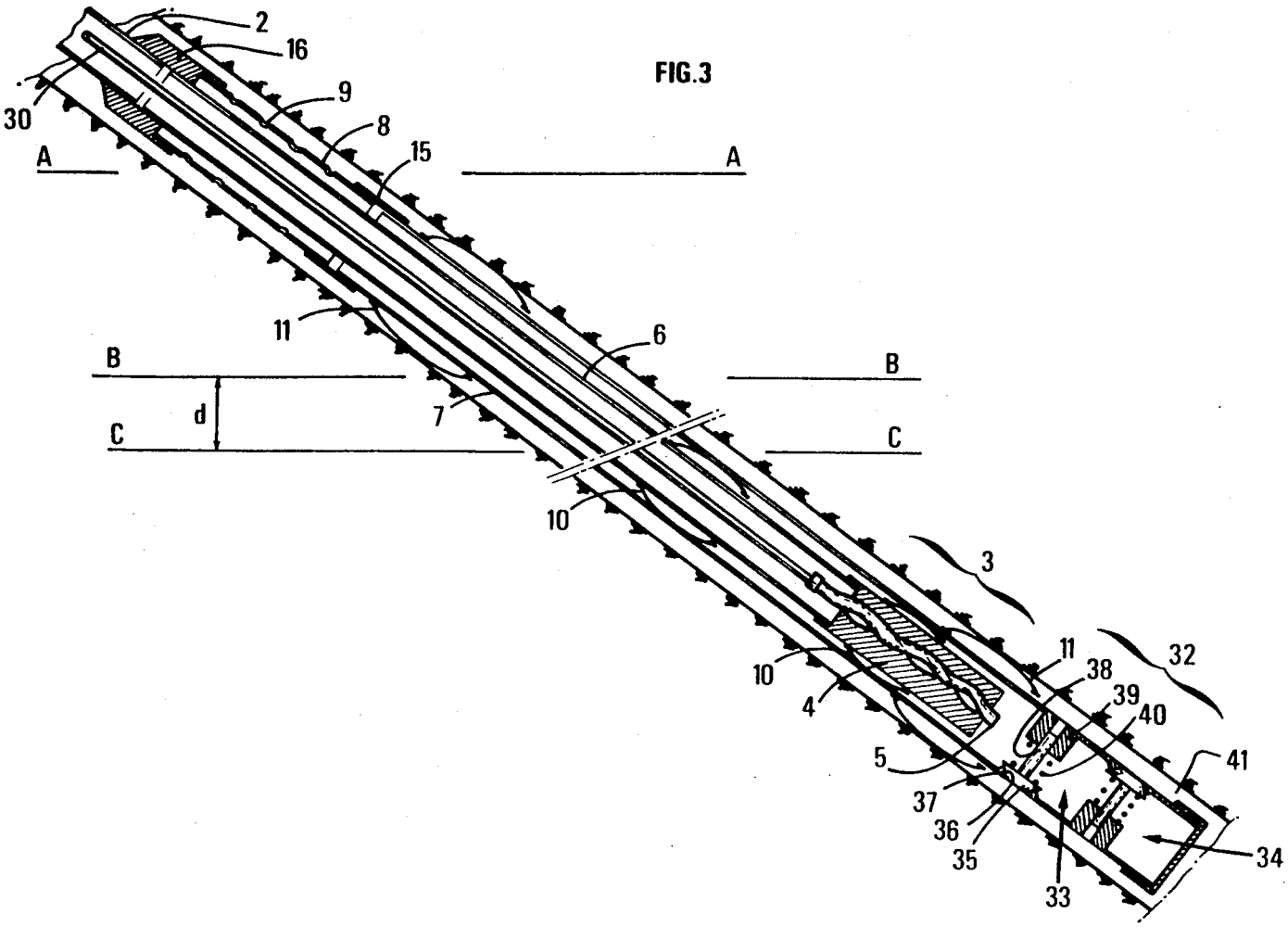

The embodiment of FIG. 3 avoids such a risk. The device according to this embodiment comprises one or more valves disposed circumferentially about the lateral or cylindrical walls of the bottom end of the intake duct, the requisite being that it is below the intake level of the pump.

The closing system 32 shown in FIG. 3 comprises two closing devices 33 and 34 positioned under pump 3 and oriented in diametrically opposite directions. The closure devices 33 and 34 are superimposed relatively to the axis of the intake duct 7.

By using two closing devices, the operational safety of the closing device is increased since it is sufficient for one of the closing devices to ensure a continuous fluid supply for the pump.

These two closing devices being identical, only a single one will be described.

The closing device 33 comprises a closing device 35 having a conical bearing surface 36 which cooperates with a conical seat 37 at the lower end of the intake duct.

Closing device 35 is guided by a cylindrical rod 38 which cooperates with a cylindrical housing 39 also carried by the intake duct 7.

Follow up means 40, such as a helical spring surrounding rod 38, applies the closing device 35 against its seat 37.

The orientation of the conical surfaces of the closing device 35 and seat 37 is such that the closing device prevents the flow of a fluid coming from inside the intake duct 7 and going towards the annular space 41 defined by the walls of the well and the external surface of the intake duct 7.

The principle of separating the free gas from the liquid is achieved in the following way, with reference to FIG. 2.

The gas/liquid mixture rises in the well and meets the closing device which holds the ball so that it blocks opening 23. The mixture progresses laterally around the intake duct 7 as far as the separation duct 8. The pumping assembly has been lowered into the well so that the dynamic level of the mixture (shown by a line A in FIG. 1) is substantially above the separation duct.

The orifices disposed evenly around the separation duct 8 allow fluid to be introduced into the intake duct. When the fluid is driven to the bottom of the intake duct, a degassing phenomenon occurs at the level of the surface of the mixture, with the gas escaping towards the surface through the well and the fluid falling back into the intake duct.

However, problems develop if the dynamic level drops below a limit position (shown at A in FIG. 2) where the intake orifices 9 of the separation duct are situated. In fact, if the level is lower (such as the level shown by line B) there will be no introduction of fluid into the intake duct which will be progressively emptied, until the pump no longer draws in fluid and so operates dry.

In the case of a drop in the dynamic level above orifices 9, the level stabilizes in the well; whereas the pumping action will rapidly lower the level inside the duct creating a difference of level d. This difference of level generates a pressure difference which compensates for the effect of the spring against the closure ball 23.

This pressure difference creates a force against the ball which moves away from its seat and allows the fluid/gas mixture to enter directly through the bottom end of the assembly. The pump is then constantly supplied with fluid. It then only remains to, reduce the speed of rotation and so delivery of the pump to cause the dynamic level to rise to the height of separation duct 8 or to adjust the operating ducts. The pressures are balanced then between the outside and inside of the intake duct 7, the ball comes back to bear on its seat and blocks the opening and the separation phenomenon may again take place.

This procedure for balancing the pressure also takes place when the assembly is initially lowered and when the intake duct 7 is empty of any fluid. In this state, the pump is not yet operative and when the pressures are balanced, the pump is brought into service.

The choice of the helical spring will therefore be made so that opening of the valve is achieved when the level of the fluid in the intake duct 7 is half way between the pump and the separation duct (shown by the line C).

In the case where the device is equipped with the intake closure device variant shown in FIG. 3, the principle of separating the free gas from the liquid is identical to the principle described above for FIG. 2, except for the variant of the operation of the closure device, whose principle steps are given hereafter.

In the case of a drop in the dynamic level below orifices 9, the level is stabilized in the well whereas the pumping action causes the level inside the duct to drop rapidly and creates a difference of level d. This difference of level generates a pressure difference which will compensate for the effect of the follow up means 40 against closure means 35.

This pressure difference implies a force against the closing device 35 which moves away from its seat 37 and allows the fluid/gas mixture to enter directly through the bottom of the assembly. The pump is therefore constantly supplied with fluid.

It is sufficient for a single one of the closure devices to operate, the devices being able to operate alone or simultaneously.

It then only remains to adjust the operating ducts, or reduce the rotational speed and so the delivery of the pump to cause the dynamic level to rise to the height of the separation duct 8. The pressures are then balanced between the outside and inside of the intake duct 7, the closing device 5 comes back to bear on its seat 37 to block the opening and the separation phenomenon may again take place.

All that has been said above for the closing device described in FIG. 2 in so far as the balancing procedure and choice of helical spring are concerned remains valid for the device shown in FIG. 3.

In a preferred embodiment in the case of a 70° orientation of the well, such as shown in FIG. 1, the intake duct 7 has a length L practically of 60 meters and the intermediate tube 6 has a length of about 45 meters, the pump as well as a fluid reservoir then having a length l of 15 meters.

As for the separation duct 8 it has a length of one meter.

However, the length of the intake duct 7 may be adapted in the case of a different well orientation, so as to constantly have a pressure difference of a few bars between the intake level of the pump 3 and the level of the orifices 9 of the separation duct.

The present invention applies quite particularly in the case of highly deviated wells which may substantially approach the horizontal. It has however the same application in the case of vertical wells.

Naturally, the invention is in no wise limited by the features which have been specifically discussed above or by the details of the particular embodiments chosen for illustrating the invention. All sorts of variants may be made to the particular embodiment which has just been described by way of example and to its component elements without departing from the scope of the invention. This latter covers then all the means forming technical equivalents of the technical means described, as well as combinations thereof.

What is claimed is:

1. A separation device for separating a mixture of free gas and liquid at the intake of a pump connected to a bottom end of a tubular column at the bottom of a drilled well, the pump being connected to the tubular column by an intermediate production tube, said separation device comprising a fluid intake device, a bottom end of which is closed and a top end of which comprises fluid introduction orifices, said pump being located inside said fluid intake device close to the bottom end; said fluid intake device further comprising, close to the bottom end, at least one check valve.

2. A device as claimed in claim 1, wherein the fluid intake device comprises a tube and said at least one check valve is placed along the longitudinal axis of said tube.

3. A device as claimed in claim 1, wherein said fluid intake comprises a cylindrical tube, said device forming at least one check valve being placed on the cylindrical walls of said fluid intake device.

4. A device as claimed in claim 3, wherein said fluid intake device comprises an intake duct surrounding the intermediate production tube and the pump coaxially, said intake duct being extended by a separation duct having orifices circumferentially and being held in position around said tubular column by a fixing piece.

5. A device as claimed in claim 4, wherein the intermediate production tube and the pump are held in position coaxially to the intake duct by centering means.

6. A device as claimed in claim 1, wherein the at least one check valve comprises a closing device constantly urged by elastic means to block a fluid introduction opening in the fluid intake duct.

7. A device as claimed in claim 6, wherein the elastic means have a compression resistance at a minimum pressure, said minimum pressure corresponding to a liquid level in the intake duct above the pump.

8. A device as claimed in claim 4, wherein the intake duct and the separation duct are held in position in the drilled well by stabilizers.

9. The separation device as claimed in claim 4, wherein the length of the fluid intake device is chosen so as to develop a pressure difference of a few bars between the intake level of the pump and the level of the fluid introduction orifices in said device.

10. Pumping installation in a drilled well comprising a separation device as claimed in any one of claims 2 to 9 and claim 1, wherein said well comprises a bottom zone whose orientation varies from the vertical to a high slope.

* * * * *